United States Patent [19]

Burtenshaw

[11] 4,036,120

[45] July 19, 1977

[54] VENTILATORS

[75] Inventor: Raymond Alfred Frank Burtenshaw, Clanfield, England

[73] Assignee: Colt International Limited, Hampshire, England

[21] Appl. No.: 631,905

[22] Filed: Nov. 14, 1975

[51] Int. Cl.[2] ..... F24F 7/06

[52] U.S. Cl. ..... 98/43 R; 98/43 C; 98/66 A; 98/82; 98/116

[58] Field of Search ..... 98/43 R, 86, 43 C, 82, 98/66 A, 116; 52/198, 199

[56] References Cited

U.S. PATENT DOCUMENTS

| | | | |
|---|---|---|---|
| 1,897,440 | 2/1933 | Richardson | 98/82 |
| 1,907,727 | 5/1933 | Breident | 98/43 |
| 2,332,552 | 10/1943 | Belanger | 98/116 |
| 2,588,289 | 3/1952 | Pouliot | 52/199 |
| 3,202,080 | 8/1965 | Cook | 98/116 |
| 3,212,425 | 10/1965 | Hazen et al. | 98/43 R |
| 3,396,652 | 8/1968 | Morrison et al. | 98/116 |
| 3,412,670 | 11/1968 | Jenn et al. | 98/116 |

FOREIGN PATENT DOCUMENTS

| | | | |
|---|---|---|---|
| 1,386,326 | 12/1964 | France | 98/43 R |

*Primary Examiner*—John J. Camby
*Assistant Examiner*—Henry C. Yuen
*Attorney, Agent, or Firm*—Flynn & Frishauf

[57] ABSTRACT

A dual purpose design for a powered discharge roof ventilator has a fan mounted in a body housing having a bottom opening to be positioned in the roof structure, a top wall weathering the opening, and inclined side openings for the discharge of air. Hinged flaps guide the discharging air and close the openings to water entry when the fan is stationary. The flaps are capable of being mounted either to direct discharging air upwardly or downwardly. Automatic flap locking and unlocking means secure the flaps closed when the fan is non-operative and unlock when the fan is started up.

16 Claims, 7 Drawing Figures

VENTILATORS

Figure 1:
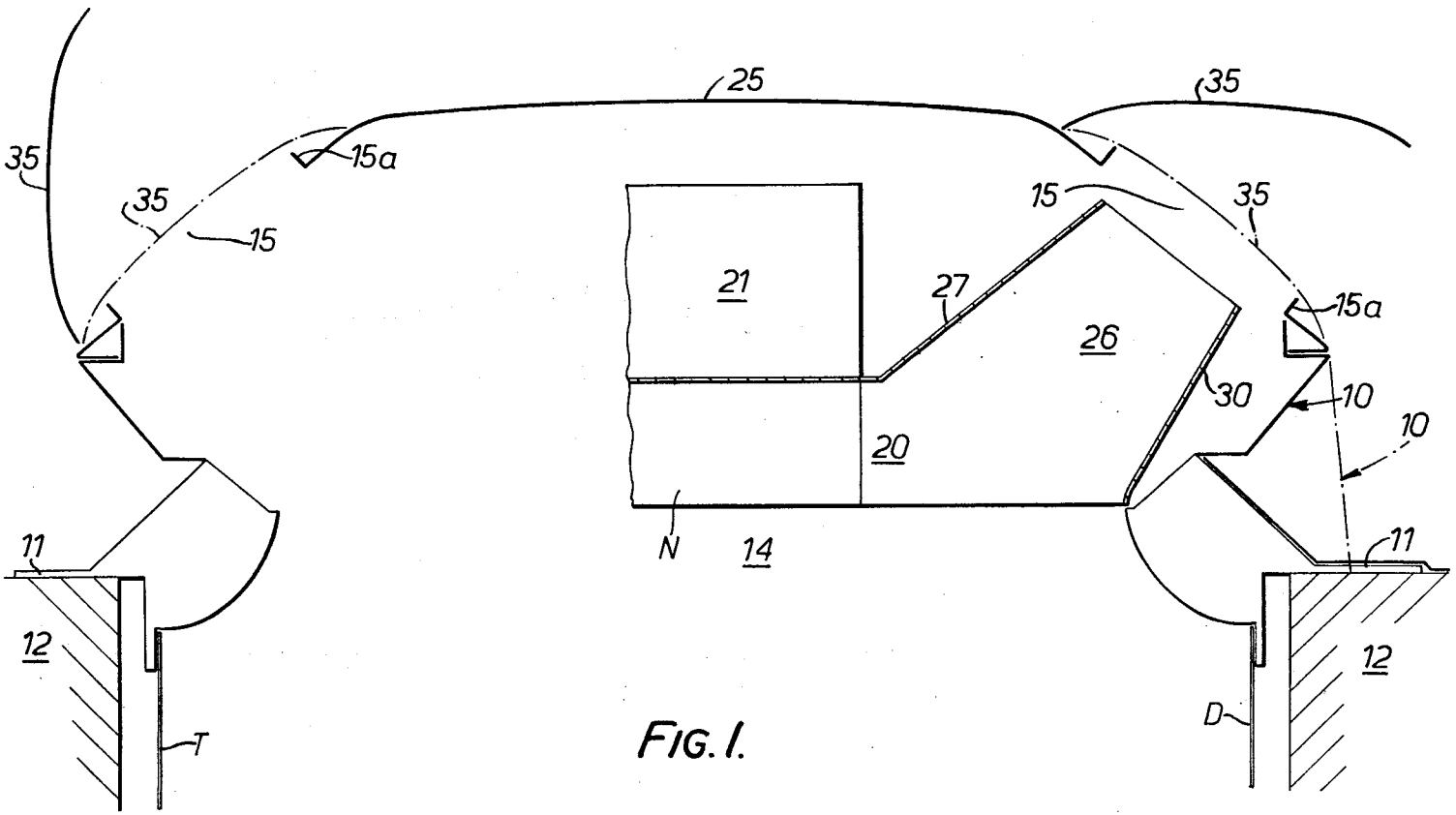

This invention relates to ventilators and concerns powered extract roof ventilators.

Such ventilators are of two general types for downward and upward discharge of the air respectively. The former type has a cowl or weatherhood which is designed to prevent weather entry through the ventilator and which guides the exhausting air, extracted by the ventilator, outwardly and downwardly towards the outside of the roof cladding. The latter type discharges its air directly upwardly away from the roof cladding.

Both types of ventilator may be provided with non-return shutters to prevent down draughts through the ventilator when the ventilator is not operating, and in the case of the upward discharge type of ventilator also weather entry through the ventilator. The upward discharge type may be designed so that during operation of the ventilator the discharging air stream from the ventilator prevents weather entry through the ventilator.

It is known to provide an upward discharge powered extract roof ventilator comprising a fan, a body housing presenting a bottom ventilation opening to be positioned in the roof structure, and a top wall for weathering the ventilation opening, the body housing having side openings for the discharge of air drawn into the body housing by the fan impeller which is housed in the body housing and arranged to draw air into the body housing through the ventilation opening, hinged flaps being provided, one for each side opening, and swingable between open and closed positions in which the flap guides air discharged through the side opening upwards away from the roof structure and closes the side opening respectively.

The present invention provides a powered extract roof ventilator comprising a fan, a body housing presenting a bottom ventilation opening to be positioned in the roof structure, and a top wall and a side wall or walls for weathering the ventilation opening, there being one or more side openings, each in a side wall of the body housing which is downwardly inclined from said top wall, and each defined by a surrounding wall on the outside of the inclined side wall and projecting outwardly of the body housing, the fan impeller being housed in the body housing, and being arranged to draw air into the body housing through said ventilation opening and discharge it through said side opening or openings, and for each of the said side openings a dished flap on the outside of the body housing and hinged to the body housing so as to be swingable between open and closed positions in which the flap guides air discharged through the side opening and closes the side opening respectively, the flap in its closed position overhanging the surrounding wall defining the side opening to the outside thereof and in spaced relation thereto around its whole periphery, thereby to weather the side opening.

The flap or flaps acts as non-return shutters to close the side openings when the ventilator is not operating to prevent downdraughts through the side openings and also to prevent weather entry through the side openings.

This is achieved by the provision of the side opening or openings in downwardly inclined walls of the body housing, and by the surrounding wals defining the openings, which direct water draining down the outside of the inclined walls away from the side openings, and by the dished form of the flaps which overhang the surrounding walls on the outside to prevent water splashing into the side openings at any point while at the same time being spaced from the surrounding walls so that water cannot penetrate between the flaps and the surrounding walls by capillary action. The positioning of the flap hinge axis to one side of the side openings, enables this co-operating configuration of flap and side opening to be achieved.

Preferably each flap is hinged to the body housing about a hinge axis disposed to one side of the opening since this simplifies the hinging arrangements.

The or each flap may be hinged to the body housing to that side of its side opening adjacent the ventilation opening so that in its open position, it guides the air discharged through its side opening upwardly away from the outside of the roof structure.

Alternatively, the or each flap may be hinged to the body housing so that side of its side opening adjacent the top wall of the body housing so that, in its open position, it guides the air discharged through its side opening outwardly and downwardly towards the outside of the roof structure.

In the latter case the ventilator operates as a powered extract roof ventilator of the downward discharge type and in the former case as a powered extract roof ventilator of the upward discharge type.

Preferably, the ventilator is adapted interchangeably to mount the or each flap to move between its closed position and an open position in which it guides air discharged through its side opening upwardly away from the outside of the roof structure and to an open position in which it guides air discharged through its side opening outwardly and downwardly towards the outside of the roof structure.

Thus an upward discharge ventilator of the invention may be converted to a downward discharge ventilator of the invention and vice versa simply by interchanging the flap hinge positions.

The fan may employ a centrifugal impeller to draw in air axially through the ventilation opening and discharge it radially through the side opening or openings.

Alternatively the fan may employ an axial flow impeller to draw in air axially through the ventilation opening and cause it to be charged through the side opening or openings, guide means being employed to guide the axially moving air discharged from the impeller upwardly and outwardly through the side opening or openings.

It is preferred, however, that the fan employ a mixed flow impeller which draws in air axially through the ventilation opening and discharges it directly upwardly and outwardly through the side opening or openings.

Preferably also, a plurality of said side openings are provided surrounding the axis of the fan impeller.

In order to lock each flap in its closed position when the ventilator is not operating, to prevent it opened by the action of wind blowing on to or over the ventilator or over a structure such as a building carrying the ventilator, and to unlock the flap, to allow the flap to open, when the ventilator is operated, a solinoid operated detent may be provided movable from a locking position to a withdrawn position upon energisation of the solinoid, and an electrical switch in circuit with the solinoid, the switch being maintained operated to set the solinoid for energisation when the flap is in its closed position, the detent, in its locking position, locking the flap closed, and in its withdrawn position unlocking the flap to allow the flap to open, the arrangement being such that the opening of the flap operates said switch to de-energise the solinoid and allow the detent to return to its locking position.

The solinoid may be connected in circuit with the fan motor to be energised when the motor is energised and said switch is closed.

Preferably, the detent is spring pressed to its locking position, the flap displacing the detent against the action of its spring when the flap returns to its closed position, the spring thereafter engaging the detent with the flap to lock the flap closed.

Figure 2:
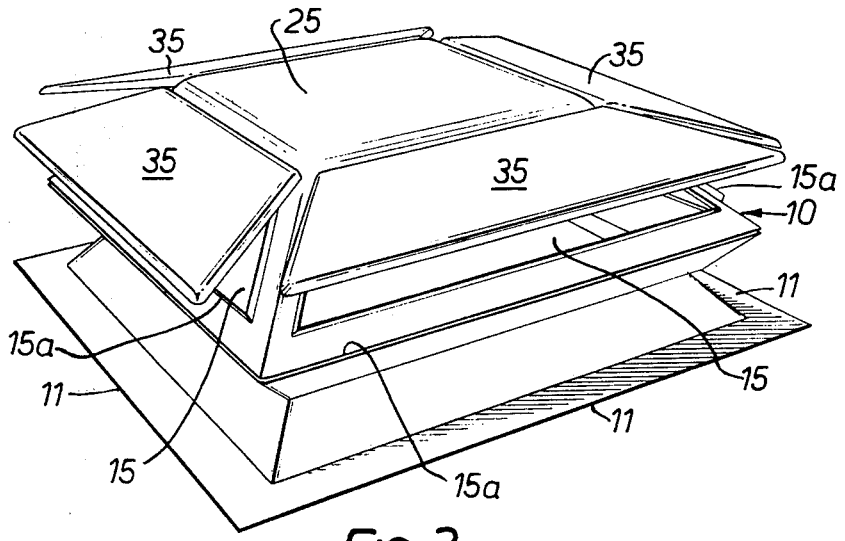
Figure 3:
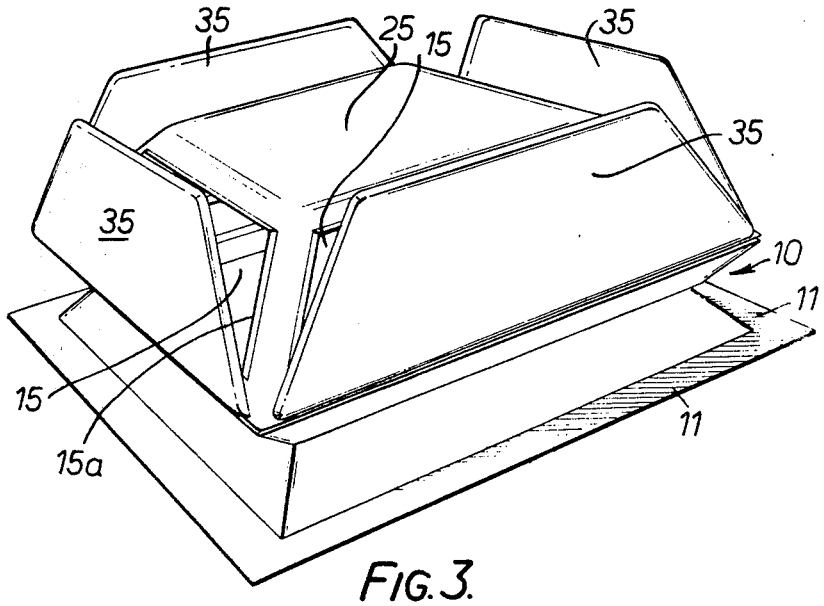
Figure 4:
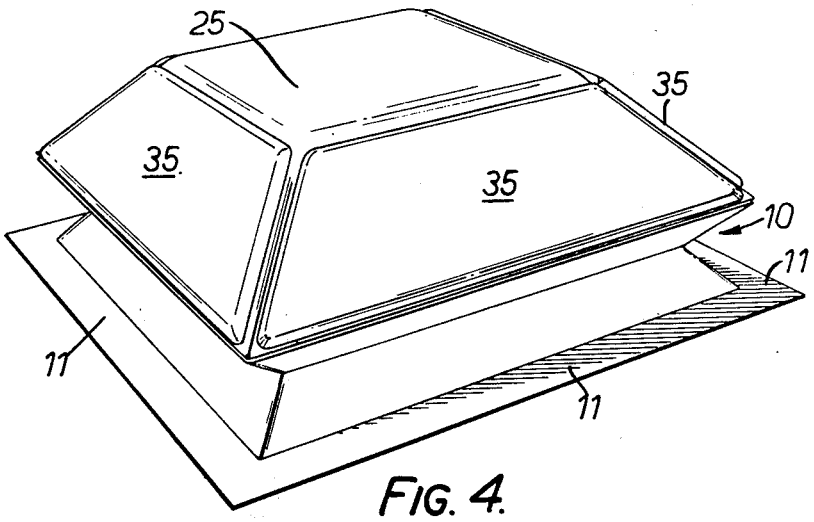
Figure 5:
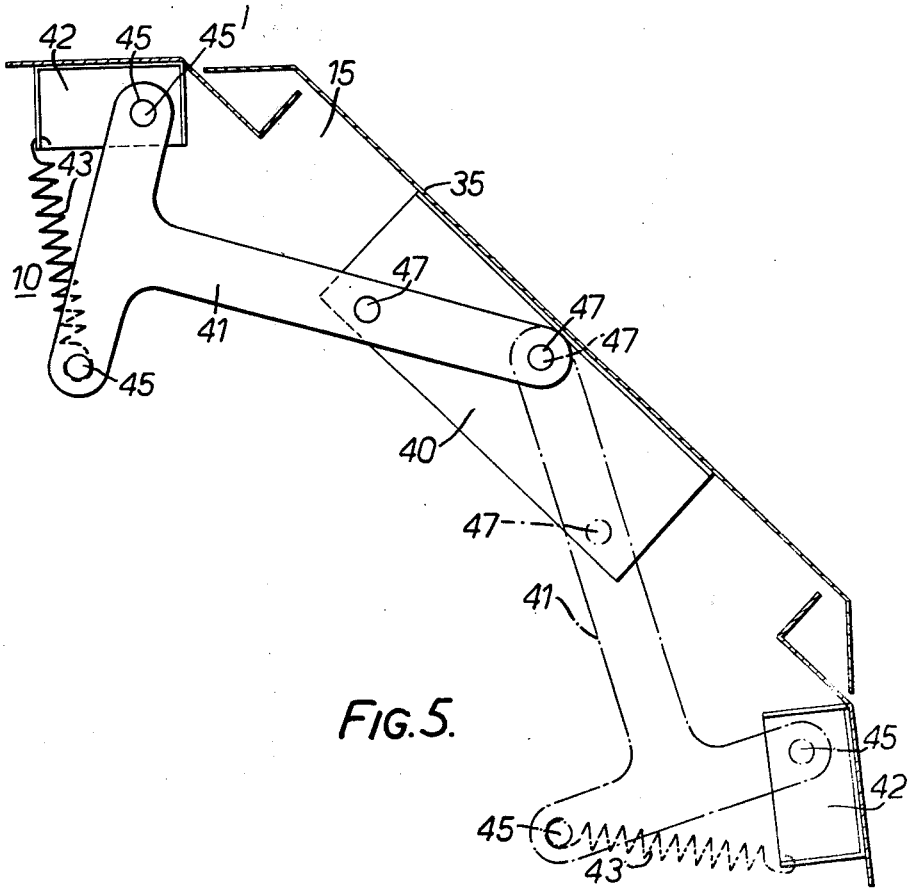
Figure 6:
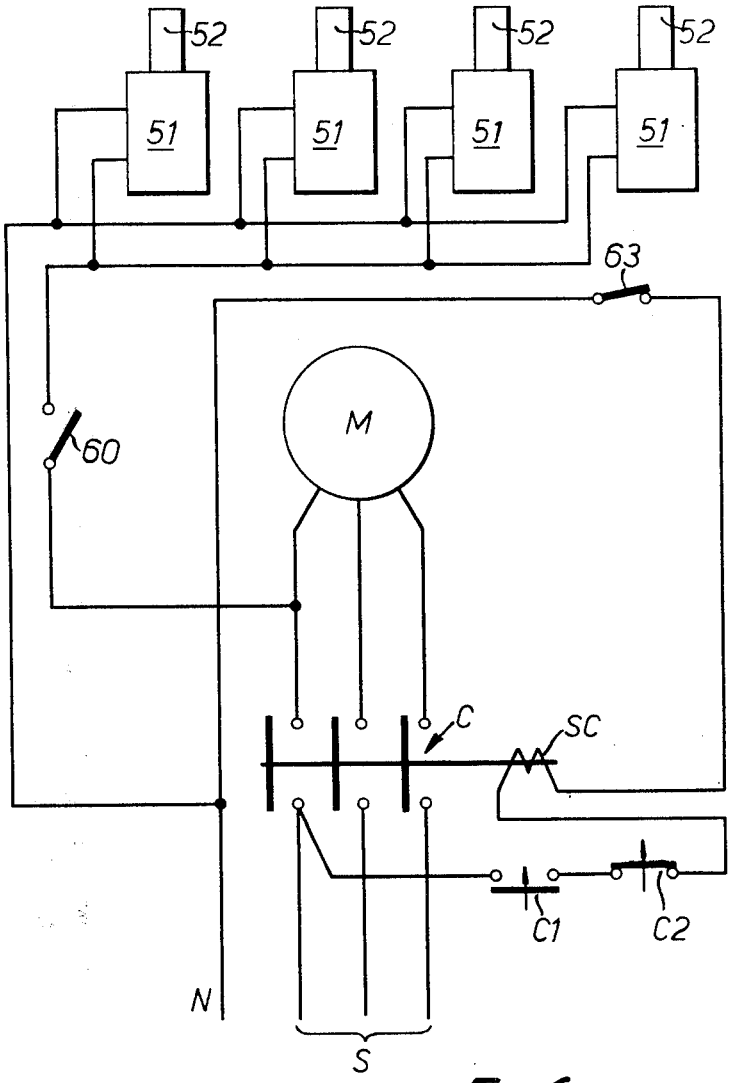
Figure 7:
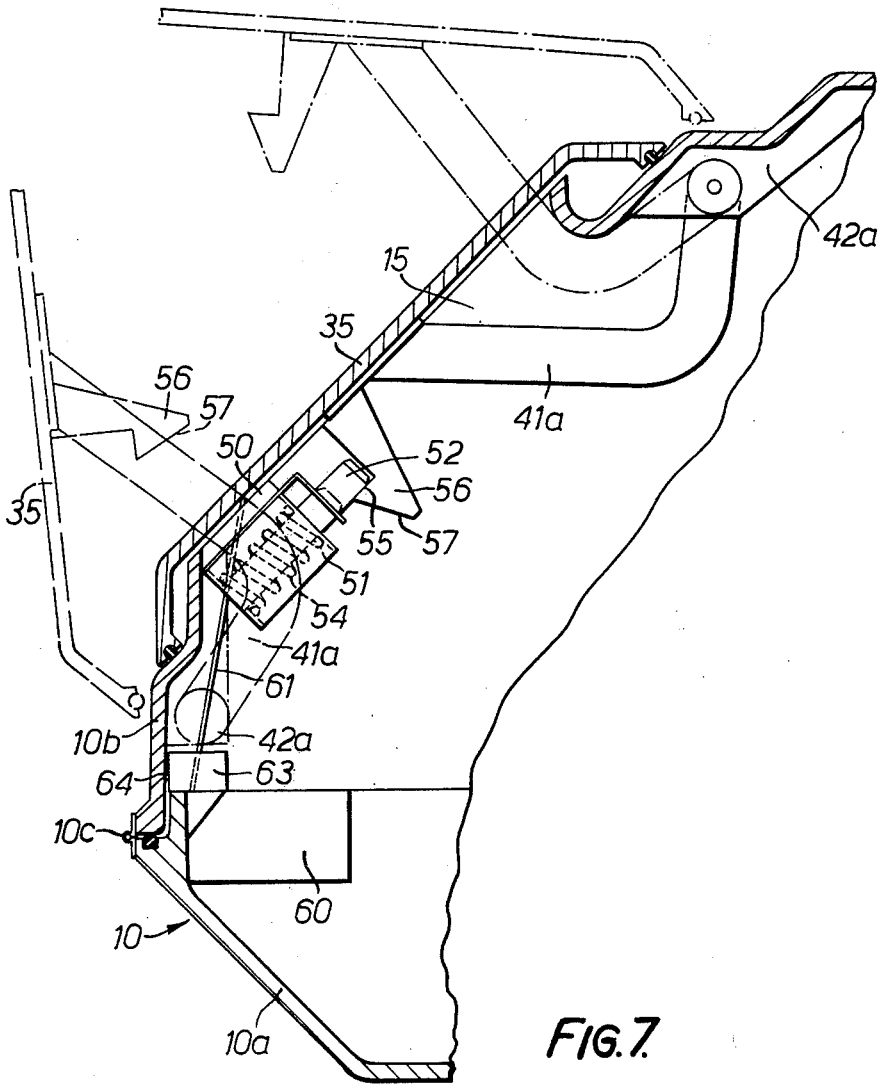

Specific embodiments of the present invention will now be described by way of example with reference to the accompanying drawings in which:

FIG. 1 is a diagrammatic cross-sectional representation showing, at opposite sides, two different types of ventilator in accordance with the present invention, FIG. 2 is a perspective view of one of the ventilator types illustrated in FIG. 1 with its flaps in their open position, FIG. 3 is a perspective view of the other of the ventilator types illustrated in FIG. 1 with its flaps in their open position, FIG. 4 is perspective view corresponding with FIGS. 3 and 4 and showing the flaps in their closed position, FIG. 5 shows interchangeable means for hinging the flaps, FIG. 6 is a circuit diagram, and FIG. 7 is a partial view in cross-section of a further powered roof extract ventilator in accordance with the present invention.

Referring to the accompanying drawings, the ventilators, which are about to be described, by way of example and not by way of limitation, have a four-sided body housing 10 with outwardly directed flanges 11 one on each of its four sides by means of which the ventilator is intended to be flashed to the outside of a roof structure 12 so as to cover over an opening in the roof structure. The body 10 presents a downwardly directed ventilation opening 14 which may communicate directly with a space to be ventilated inside the roof structure or with trunking T leading to such a space. The body housing further presents four side openings 15, one in each of its four sides. The ventilation opening 14 comprises a short converging bell mouthed entry duct D leading air to a fan impeller 20 driven directly by a motor 21 mounted in the upper part of the body 10 immediately beneath a top bounding exterior wall 25 of the body which is of shallow domed configuration. The impeller 20 has its axis of rotation coincident with the axis of the opening 14 and is of the mixed flow type having blades 26 mounted on a frusto conical hub 27, the blades carrying a frusto conical shroud ring 30 which defines with the hub a radially enlarging and axially extending passage in which the blades themselves are located.

The nose N of the motor 21 projects to the inlet opening 14 upstream of the impeller so that air drawn in axially through the inlet opening by the impeller flows over the motor nose to cool the motor.

The impeller 20 discharges the air upwardly and outwardly through the side openings 15 which are formed in side wall portions of the body 10 which are downwardly inclined from the top wall 25 at an angle of about 45°. As can now be appreciated therefore, and is apparent from FIGS. 2, 3 and 4, the upper part of the body is of a generally frusto pyramidal shape and the openings 15 are trapezoidal in shape and directed upwardly and outwardly with respect to the body 10.

As so far described, the ventilators are of the same construction.

The ventilators are provided with four hinged flaps 35 one to control each of the side openings 15 and the flaps are hinged to the body 10 so as to be movable between open and closed positions.

In their closed positions indicated in broken line in FIG. 1 and shown in FIG. 4, the flaps 35 close the side openings 15 the flaps then acting as non-return shutters. The flaps 35 are closed by the action of springs when the fan is stationary. When the fan is started up the airstream discharged by the fan moves the flaps to their open position.

Referring now to the righthand side of FIG. 1, and FIG. 2, in the ventilator of the downward discharge type, the flaps are hinged to the body 10 adjacent the upper edges of the side openings so as to swing upwardly and outwardly, and in their open position they guide the air discharged through the side openings radially outwardly and downwardly towards the outside of the roof structure 12. The flaps 35 then form extensions of the top wall 25 of the body 10, and act therewith as a cowl or weatherhood for the ventilator, sheltering and weathering the ventilation opening 14.

Referring to the lefthand side of FIG. 1 and FIG. 3, the ventilator of the upward discharge type has its flaps 35 hinged to the body 10 adjacent the lower edges of the side openings so as to swing outwardly and upwardly, and in their open position they guide the air discharging through the side openings 15 to flow generally in a vertically upward direction. Stop means, later described, is provided to limit the opening movement of the flaps 35 in this case.

Each opening 15 has a surrounding wall **15*a* on the outside of its inclined side wall portion, and projecting outwardly of the body housing 10, and the flaps 35 are of a dished configuration so as to overhang the walls 15*a* to the outside thereof and in spaced relation thereto around the whole of their periphery. With this construction each flap is better able to prevent the entry of rainwater through its opening when the flap is in its closed position, the wall 15*a*** guiding any water which penetrates under the edge of the flap around the outside of the opening so that it drains onto the outside of the roof structure.

Referring now to FIG. 5, in order that the flaps may readily be adapted to swing open as desired, each flap is provided with two L-shaped mounting brackets 40 for T-shaped hinge arms 41 interchangeably hingeable to pivot brackets 42 fixed respectively to the body 10 adjacent the upper and lower edges of the openings 15. The flap closing springs already referred to are indicated at 43. The hinge arm 41 and spring 43 shown in full line indicate the positioning of these parts in order to hinge the flaps for upward and outward swinging movement, in which case the brackets 42 adjacent the lower edge of the opening 15 are left unused. The hinge arm 41 and spring 43 shown in dotted line indicate the positioning of these parts in order to hinge the flaps for upward discharge, the brackets 42 adjacent the upper edge of the openings 15 then being left unused. Holes 45, one towards each ends of the cross pieces of the T-shaped arms 41, are used alternatively to pivot these arms to the pivot brackets 40, about a hinge pin 45', the other hole being used in each case to anchor one end of the springs 43, the other ends of which are anchored to the body 10. Two further holes 47 in the stem of each T-shaped arm 41 are used to secure the arm 41 to one of flaps are to be hinged.

The arms 41 engage the body housing 10 to limit the opening movement of the flaps.

The hinge axis of each flap is defined at the center of the holes 45 in its hinge arms 41 and, in each case, is disposed to one side of the side opening 15 controlled by the flap. This disposition of the flap hinge axis permits the flaps 35 to perform their required opening and closing movements without resort to a more complicated hinging arrangement which would be necessary to hinge the flaps 35 within the side openings 15. Such hinging of the flaps within the side opening 15 is not, however, excluded. In FIG. 5 the body 10 is of a modified shape, as indicated, in broken line at the right hand side, in FIG. 1. The flaps 35 are also of a modified dished shape.

The motor 21 is conveniently mounted on chassis bars (not shown) arranged diagonally and anchored to the body 10 at the four corners of the body.

Instead of a mixed flow impeller 20, a centrifugal impeller may be used to draw in air axially through the opening 14 and discharge it radially through the openings 15.

Again, an axial flow impeller may be used to draw in air axially through the opening 14, and discharge it axially on to an inverted conical guide fixed in the position of the conical hub 27, the guide then guiding the air upwardly and outwardly through the openings 15.

Filters may be incorporated, positioned one in each opening 15 to filter air being discharged to the atmosphere.

The flaps 35 may be inset in the inclined side wall portions of the body 10, the walls 15*a* having moat-like surrounds formed in the side wall portions which receive the peripheral edges of the flaps 35, in the closed position of the flaps, the moats acting as gutters to drain water down the side wall portions around the outside of the walls 15*a.*

Referring now to FIGS. 6 and 7, the ventilator comprises, in this case, a body housing 10 made up of lower and upper parts 10*a* and 10*b* hinged together as at 10*c.* The body part 10*a* mounts the fan (not shown), and the body part 10*b* may be swung open on the hinge 10*c* to give access to the fan for servicing.

The body part 10*b* presents four side openings, one of which is shown at 15, through which air is discharged when the fan is operated.

Each opening has a hinged non-return shutter flap 35 having a pair of hinge arms 41*a* hinged to pivot brackets 42*a* on the body 10*b,* the flap being movable to swing open, from a closed position shown in full line in FIG. 2, to an open position shown in broken line in FIG. 2 when the fan is started. To this end, the airstream generated by the fan is relied upon to exert pressure on the flap and open the flap, the flow of air out of the opening 15 thereafter holding the flap in its open position.

Each flap 15 may have an alternative hinge position as shown in chain dotted line in FIG. 2.

The body part 10*b* carries a bracket 50 which lies in the opening 15. The bracket 50 carries an electric solinoid 51 having a detent 52 movable, from a locking position shown in full line to a withdrawn position shown in chain dotted line, by the solinoid when the solinoid is energised, against the action of a spring 54.

Upon de-energisation of the solinoid, the spring 54 returns the detent to its locking position.

The detent engages behind a shoulder 55 on a post 56 carried by the flap 35 to lock the flap in its closed position. In its withdrawn position, the detent clears the shoulder 55 to allow the flap to open. Upon re-closing of the flap, when the fan is shut down, an inclined camming face 57 on the poast engages and forces back the detent 52 to allow it to re-engage behind the shoulder 55 under the action of its spring when the flap reaches its closed position.

The disposition of the post 56 and the solinoid operated detent 52 is such that the flap 15 may be hinged at either of its alternative hinge positions whilst permitting the locking and unlocking action described. Thus, the camming face 57 swings on an arc about either hinge axis such as to strike and force back the detent as the flap moves to its closed position, the detent then moving to engage behind the shoulder 55,

A micro-switch 60 mounted on the body part 10*b* has an operating arm 61 engaged and held deflected by the flap 15 when the flap is closed, thereby to close the switch. Upon opening of the flap, the switch 60 is also opened.

A micro-switch 63 mounted on the body part 10*b* adjacent the hinge 10*c,* has an operating member 64 engaged and held depressed by the body part 10*b* so long as the body part 10*b* is not swung open on the hinge 10*c.*

Referring now to FIG. 6, four solinoid operated detents 51, 52 are provided, one for each of four flaps 35 in the present example, connected in parallel, across a neutral line N and the first phase of a three phase electric current supply S to the fan motor M via the microswitch 60 which is associated with only of the flaps 35.

A solinoid operated contactor C, at a remote location, controls the supply of three phase current to the fan motor M and press button start and stop switches C1 and C2 are associated with the contactor to energise and de-energise its solinoid SC to make and break the contactor. The solinoid SC is also energised by connection across the line N and the first phase of the supply S, via the switch 63 which ensures that the fan cannot be started if the body part 10*b* is swung open.

Upon starting the motor, the solinoids 51 are energized, micro-switch 60 being closed. The detents 52 are accordingly all withdrawn, releasing the flaps 35 and allowing them to open in the airstream generated by the fan. Opening of the flap 35 associated with the microswitch 60 frees its operating arm 61 and the switch 60 opens thereby de-energising the solinoids 51 and the detents 52 return to their locking position ready to lock the flaps 35 in their closed position when the motor M is shut off at the stop press button switch C2.

The arrangement described with reference to FIGS. 6 and 7 is applicable to lock any ventilator flap in a closed position and is not restricted to hinged flaps; nor is it restricted to powered ventilators.

I claim:

1. A powered extract roof ventilator comprising:

a fan including a fan impeller, a body housing presenting a bottom ventilation opening to be positioned in the roof structure, and having a top wall for weathering the ventilation opening and a plurality of side walls which are downwardly and outwardly inclined from said top wall at a substantial angle to the vertical and horizontal, the body housing have side openings on all sides thereof, said openings each being formed in a respective side wall of the body housing which is downwardly and outwardly inclined from said top wall at a substantial angle to the vertical and horizontal, each side opening being defined by a surrounding wall on the outside of the inclined side wall and projecting outwardly of the body housing to form a gutter with the side wall to drain water down the outside of the side wall portions around the respective opening, the fan impeller being housed in the body housing and being arranged to draw air into the body housing through said ventilation opening and to discharge air through said side openings, and dished flaps associated respectively with each of said side openings, said dished flaps being located on the outside of the body housing in registration with its respective side opening and hinged to the body housing so as to be swingable between open and closed positions in which each flap guies air discharged through the respective side opening and closes the respective side opening respectively, each flap in its closed position overhanging the complete surrounding wall defining the respective side opening to the outside thereof and in spaced relation thereto around its whole periphery, thereby to weather the respective side opening.

2. A powered extract roof ventilator as claimed in claim 1 in which each flap is hinged to the body housing about a hinge axis disposed to that side of the side opening adjacent the top wall of the body housing so that, in its open position, it guides the air discharged through its side opening ouwardly and downwardly towards the outside of the roof structure, the flaps in their open position forming and extension of said top wall, the flaps then overlying and weathering the side openings.

3. A powered extract roof ventilator as claimed in claim 2 including pivot brackets hinging hinge pins to define each hinge axis between the body housing and each flap, and further hinge fittings are provided interchangeably to hinge each flap about a hinge axis to that side of its side opening adjacent the ventilation opening to move between its closed position and an open position in which it guides air discharged through its side opening upwardly away from the outside of the roof structure.

4. A powered discharge roof ventilator as claimed in claim 3 in which said hinge fittings include Tee-shaped hinge arms each having a stem and a cross arm, and each flap has a mounting bracket permanently pivotably mounting the stem of a Tee-shaped hinge arm interchangeably hingeable to one of two pivot brackets on the body housing disposed on opposite sides of the side opening associated with the flap, the Tee-shaped hinge arm having its stem detachably anchored to its mounting bracket at a location spaced from its pivotal connection therewith and having one end of its cross arm hingeably connected to one of its pivot brackets.

5. A powered discharge roof ventilator as claimed in claim 4 in which a spring is provided connected between the other end of said cross arm and said one of said pivot brackets and urging the flap into its closed position.

6. A powered extract roof ventilator as claimed in claim 4 in which the hinge arm engages the body housing to limit the opening movement of the flap.

7. A powered extract roof ventilator as claimed in claim 1 in which the fan impeller is a mixed flow impeller arranged to draw in air axially through the ventilation opening and to discharge it directly upwardly and outwardly through the side openings.

8. A powered extract roof ventilator as claimed in claim 7 in which the fan impeller has blades mounted on a frusto-conical hub, the blades carrying a frusto-conical shroud ring which defines with the hub a radially enlarging and axially extending passage in which the blades themselves are located.

9. A powered extract roof ventilator as claimed in claim 1 in which said side walls of the body housing are downwardly inclined at 45° with respect to said top wall.

10. A powered extract roof ventilator as claimed in claim 1 in which said body housing is four sided and presents four of said downwardly and outwardly inclined side walls.

11. A powered extract roof ventilator as claimed in claim 1 in which the ventilation opening comprises a bell mouthed entry duct for leading air to the fan impeller.

12. A powered extract roof ventilator as claimed in claim 11 in which the nose of the motor projects into the ventilation opening upstream of the impeller so that air drawn in axially through the inlet opening by the impeller flows over the motor nose to cool the motor.

13. A powered extract roof ventilator as claimed in claim 1 comprising an electric motor directly driving the fan impeller, the electric motor being mounted in the upper part of the body housing above the impeller.

14. A powered extract roof ventilator comprising:

a fan including a fan impeller, a body housing presenting a bottom ventilation opening to be positioned in the roof structure, and a top wall for weathering the ventilation opening, the body housing having side openings on all sides and formed each in a side wall of the body housing which is downwardly and outwardly inclined from said top wall at a substantial angle to the vertical and horizontal directions, each side openings being defined by a surrounding wall on the outside of the inclined side wall and projecting outwardly of the body housing, the fan impeller being housed in the body housing and being arranged to draw air into the body housing through said ventilation opening and to discharge it through said side openings, dished flaps associated respectively with each of said side openings, said disched flaps being located on the outside of the body housing in registration with its respective side opening and hinged to the body housing so as to be swingable between open and closed positions in which each flap guides air discharged through the respective side opening and closes the respective side opening respectively, each flap in its closed position overhanging the surrounding wall defining the respective side opening to the outside thereof and in spaced relation thereto around its whole periphery, thereby to weather the side opening, a solenoid operated detent coupled to respective flaps and mounted on the body housing and movable from a locking position to a withdrawn position upon energisation of the solenoid, an electrical switch coupled in circuit with the solenoids, and means coupled to the switch to maintain the switch operated to set the solenoids for energisation when one of said flaps is in its closed position, said detents in their locking positions locking the flaps closed and in their withdrawn positions unlocking the flaps to allow the flaps to open.

15. A powered extract roof ventilator as claimed in claim 14 in which the detents are spring pressed to their locking positions, the flaps displacing the detents against the action of their springs when the flaps return to their closed positions, the springs thereafter engaging detents with the flaps to lock the flaps closed.

16. A powered extract roof ventilator as claimed in claim 15 in which each flap is hinged to the body housing about a hinge axis disposed to that side of its side opening adjacent said ventilation opening, and means is provided to interchangeably hinge the flap to that side of its side opening adjacent said top wall.

* * * * *